US010926504B2

(12) United States Patent
Hendrix

(10) Patent No.: US 10,926,504 B2
(45) Date of Patent: Feb. 23, 2021

(54) STOCK SUPPLY ASSEMBLY AND METHOD FOR LOADING A DUNNAGE CONVERSION MACHINE

(71) Applicant: Ranpak Corp., Concord Township, OH (US)

(72) Inventor: Ron Hendrix, Urmond (NL)

(73) Assignee: Ranpak Corp., Concord Township, OH (US)

( * ) Notice: Subject to any disclaimer, the term of this patent is extended or adjusted under 35 U.S.C. 154(b) by 86 days.

(21) Appl. No.: 16/317,609

(22) PCT Filed: Jul. 14, 2017

(86) PCT No.: PCT/US2017/042036
§ 371 (c)(1),
(2) Date: Jan. 14, 2019

(87) PCT Pub. No.: WO2018/013880
PCT Pub. Date: Jan. 18, 2018

(65) Prior Publication Data

US 2019/0291380 A1 Sep. 26, 2019

Related U.S. Application Data

(60) Provisional application No. 62/362,544, filed on Jul. 14, 2016.

(51) Int. Cl.
*B31D 5/00* (2017.01)

(52) U.S. Cl.
CPC .... *B31D 5/0039* (2013.01); *B31D 2205/0035* (2013.01)

(58) Field of Classification Search
CPC ..... B31D 2205/0035; B31D 5/0039; B31D 5/0047; B31D 2205/0082;
(Continued)

(56) References Cited

U.S. PATENT DOCUMENTS 6,910,997 B1 * 6/2005 Yampolsky ..... B26F 1/22 493/350
2005/0181924 A1 * 8/2005 Demers ..... B31F 1/0003 493/350
(Continued)

FOREIGN PATENT DOCUMENTS

CN 1348410 A 5/2002
CN 1732081 A 2/2006
(Continued)

OTHER PUBLICATIONS

The International Search Report and the Written Opinion of the International Searching Authority for Corresponding International Application PCT/US2017/042036 dated Oct. 20, 2017.
(Continued)

*Primary Examiner* — Andrew M Tecco
*Assistant Examiner* — Nicholas E Igbokwe
(74) *Attorney, Agent, or Firm* — Renner, Otto, Boisselle & Sklar, LLP

(57) ABSTRACT

A stock supply assembly for a dunnage conversion machine includes a stock material support having a support structure, such as a shelf for a stack of fan-folded sheet stock material. The stock supply assembly is rotatable between a relatively lower loading position and a relatively higher operating position vertically displaced relative to the loading position.

12 Claims, 8 Drawing Sheets

(58) Field of Classification Search
CPC ..... B31D 2205/0076; B31D 5/0043; B31D 2205/0047
See application file for complete search history.

(56) References Cited

U.S. PATENT DOCUMENTS

2006/0016008 A1* 1/2006 Choi ..... A61G 1/042 5/611
2007/0287623 A1* 12/2007 Carlson ..... B31D 5/0047 493/464
2008/0207421 A1* 8/2008 Wetsch ..... B65H 35/008 493/464
2009/0258775 A1* 10/2009 Chan ..... B31D 5/0047 493/464
2010/0160132 A1* 6/2010 Cheich ..... B31D 5/0047 493/340
2011/0053749 A1* 3/2011 Wetsch ..... B65H 1/10 493/464
2011/0053750 A1* 3/2011 Wetsch ..... B31D 5/0052 493/464
2012/0015793 A1* 1/2012 van der Kaap ..... B31D 5/0047 493/477

FOREIGN PATENT DOCUMENTS

CN 101155531 A 4/2008
CN 101370689 A 2/2009
GB 2346082 A 8/2000

OTHER PUBLICATIONS

Translation of First Office Action for corresponding Chinese National Phase Application No. 201780043668.6 dated Apr. 16, 2020.

* cited by examiner

STOCK SUPPLY ASSEMBLY AND METHOD FOR LOADING A DUNNAGE CONVERSION MACHINE

This application is a national phase of International Application No. PCT/US2017/042036, filed Jul. 14, 2017, and published in the English language, and which claims priority to U.S. Application No. 62/362,544 filed Jul. 14, 2016, both which are each hereby incorporated herein by reference in their entireties.

FIELD OF THE INVENTION

The present invention relates to machines for converting sheet stock material into a dunnage packaging product and, more particularly, to a stock supply assembly and method of facilitating loading a new supply of sheet stock material for use by a dunnage conversion machine.

BACKGROUND

Dunnage conversion machines, also referred to as converters, generally convert a sheet stock material into a relatively less dense dunnage product that is useful as packaging to protect articles during shipment. Some converters produce a dunnage product primarily intended to fill voids in a packaging container to prevent the contents from shifting during shipment, while other converters produce a dunnage product that provides more cushioning from impact or vibration.

The sheet stock material usually is supplied in the form of a roll or a fan-folded stack from which the sheet stock material is paid off for conversion by the machine into the dunnage product. When the roll or stack of sheet stock material being supplied is spent, a new roll or stack is loaded in place of the spent supply, and the leading end of the new roll or stack is inserted into the converter. An exemplary converter is disclosed in commonly-owned U.S. Pat. No. 7,186,208, which is hereby incorporated herein by reference.

SUMMARY

The present invention provides an improved stock supply assembly and method for loading a dunnage conversion machine, particularly a stock supply assembly mounted at an elevated position for operation that can be lowered to load a new supply of sheet stock material.

More particularly, the present invention provides a stock supply assembly having a support structure, such as a shelf for a stack of fan-folded sheet stock material. The stock supply assembly is rotatable between a relatively lower loading position and a relatively higher operating position vertically displaced relative to the loading position.

More particularly, the present invention provides a stock supply assembly for a dunnage conversion machine that includes a support structure that is movable between a relatively lower loading position and a relatively higher operating position vertically displaced relative to the loading position, where the support structure rotates about a horizontal axis between the loading position and the operating position.

The support structure may include a shelf for supporting a stack of fan-folded sheet stock material at a location spaced from the horizontal axis.

The shelf may be substantially horizontal in the operating position and relatively inclined in the loading position.

The support structure may include a gas spring that helps to hold the support structure in both the loading position and the operating position.

The support structure may include a support member that extends away from the shelf to help support the stack of fan-folded sheet stock material as the support structure moves between the loading position and the operating position.

The support member may be movable relative to the shelf to facilitate access to the stock supply assembly.

The support structure may include a handle that facilitates moving the stock support between the loading position and the operating position.

The handle position may control locking and unlocking the gas spring to facilitate moving the support structure between the loading position and the operating position and holding the support structure in a desired position.

The support structure may be mounted to a frame and be rotatable relative to the frame about a vertical axis.

The present invention also provides a stock supply assembly in combination with a dunnage conversion machine.

The dunnage conversion machine may convert a sheet stock material into a relatively thicker and less dense dunnage product.

The dunnage conversion machine may be mounted to the support structure and may rotate about the horizontal axis with the stock supply assembly between the loading position and the operating position.

The present invention also provides a method of loading a sheet stock material into a dunnage conversion machine for conversion into a relatively lower density dunnage product. The method includes the following steps: (a) lowering a stock material support structure from an elevated operating position to a relatively lower loading position, (b) loading a supply of sheet stock material onto the support structure at the loading position, (c) raising the support structure from the loading position to the operating position, and (d) feeding sheet stock material from the supply into a dunnage conversion machine and operating the dunnage conversion machine to produce one or more dunnage products from the supply of sheet stock material.

The method may further include the step of (e) rotating a stock supply assembly that includes the stock material support structure about a vertical axis, and the rotating step may include rotating the dunnage conversion machine.

The rotating step may include rotating the dunnage conversion machine.

The lowering step may include rotating the dunnage conversion machine about a horizontal axis to lower an upstream end of the conversion machine.

The raising step may include rotating the dunnage conversion machine about a horizontal axis to lower a downstream end of the conversion machine.

The method may further include the step of moving a support member to access a stock supply assembly when the stock supply assembly is in the loading position.

The foregoing and other features of the invention are hereinafter fully described and particularly pointed out in the claims, the following description and the annexed drawings setting forth in detail plural illustrative embodiments of the invention, such being indicative, however, of but a few of the various ways in which the principles of the invention may be employed.

DETAILED DESCRIPTION

Figure 1:
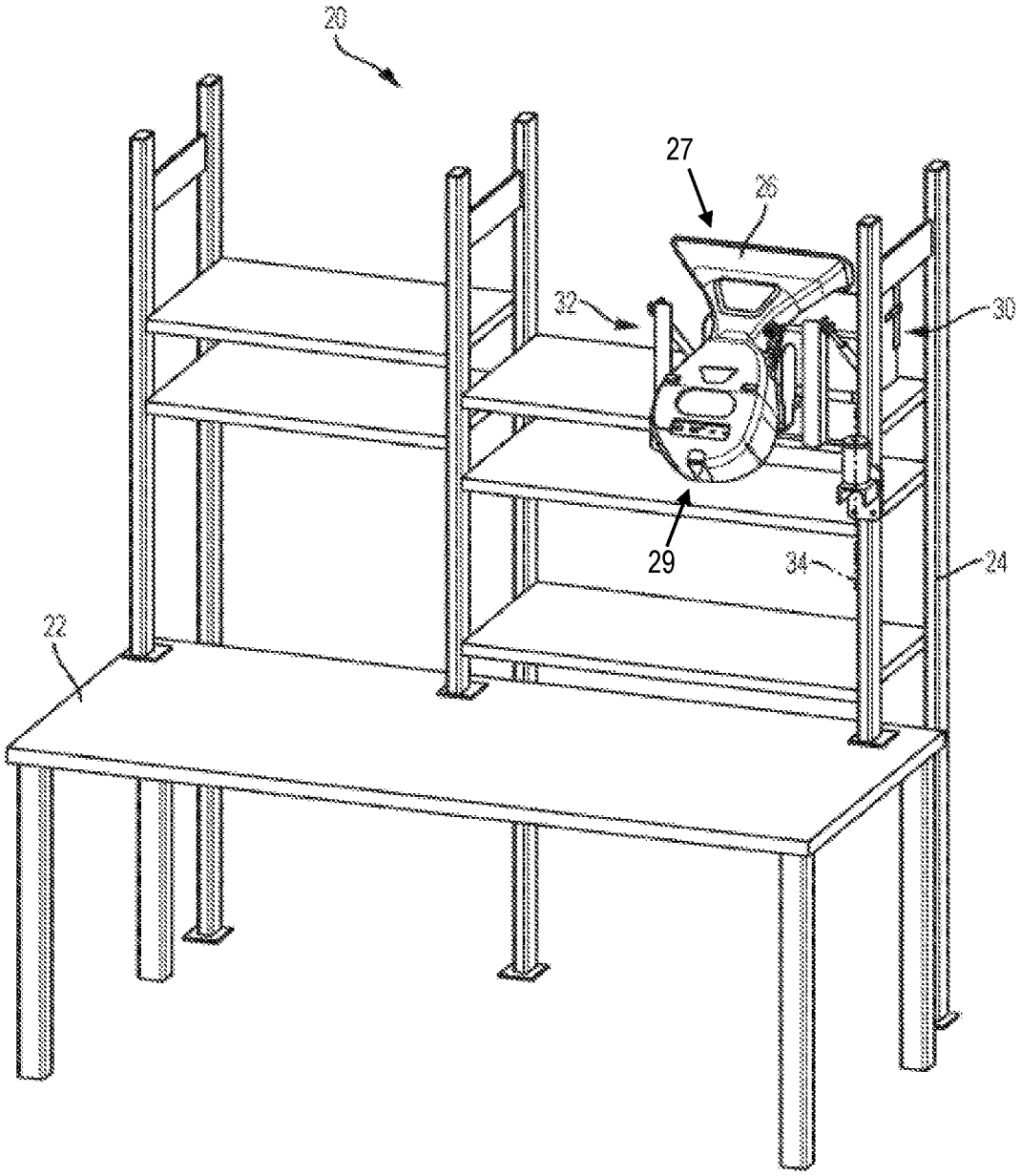
FIG. 1 is a perspective view of a packaging station that includes a dunnage conversion machine and a stock supply assembly provided by the present invention, in an operating position.

Referring now to the drawings in detail and initially to FIG. 1, an exemplary packaging station 20 is shown, with a packing surface 22 and a frame 24 that supports a dunnage conversion machine 26 and stock supply assembly 30 at an elevated position above the packing surface 22. The dunnage conversion machine may be referred to as a converter.

The converter 26 pulls sheet stock material from the stock supply assembly in a downstream direction from an upstream end 27 of and through the converter 26. The upstream end 27 of the converter 26 is adjacent the stock supply assembly 30. The converter 26 converts the stock material into a relatively less dense dunnage product that the converter dispenses from an outlet at a downstream end 29, opposite the upstream end 27.

The supply of sheet stock material generally is provided in a compact configuration, such as a roll of stock material (not shown) or a generally rectangular stack of fan-folded sheet stock material as shown. The sheet stock material includes one or more plies of sheet material. An exemplary sheet stock material is made of paper, such as kraft paper, for example thirty-pound basis weight kraft paper. Paper is biodegradable, recyclable, and composed of a renewable resource, making it an environmentally-responsible choice. But the present invention is not limited to use with paper. One or more of the plies may be made of another type of sheet material, such as a plastic sheet, or different types of paper, such as printed paper, bleached paper, fifty-pound kraft paper, or other sheet material, or combinations thereof. Because paper is reusable, recyclable, and composed of a renewable resource, it is an environmentally responsible choice as a stock material for conversion into a dunnage product.

An exemplary converter is shown in the drawings, but the present invention is not limited to the illustrated converter. The converter 26 converts a sheet stock material supported by the stock supply assembly 30 into a relatively less dense dunnage product that may be used to protect products being shipped in a packaging container, such as a cardboard box. The dunnage product may provide cushioning, blocking and bracing, or void-fill properties for the package. An exemplary converter is described in commonly-owned U.S. Pat. No. 7,186,208, which is hereby incorporated herein by reference, but the present invention is not limited to a particular converter.

The converter 26 and the stock supply assembly 30 include a support structure 32 that is mounted to the frame 24. In the illustrated embodiment, the support structure 32 is pivotally mounted to the frame 24 for pivotable movement about a vertical axis 34. Since both the stock supply assembly 30 and the converter 26 are mounted to the support structure 32, the stock supply assembly 30 can be aligned with the converter 26 and the support structure 32 will help to ensure proper alignment of the sheet stock material is maintained as it is fed into the converter 26. Rotating the support structure 32 rotates both the converter 26 and the stock supply assembly 30 without changing the alignment of the converter 26 relative to the stock supply assembly 30.

In FIG. 1, the converter 26 and the stock supply assembly 30 are in an elevated operating position, with an outlet 36 of the converter 26 facing the packing surface 22, ready to dispense a dunnage product to a packer for insertion into a shipping container. As the converter 26 operates, sheet stock material is drawn from the stock supply assembly 30 and consumed. Eventually the sheet stock material is depleted and the stock supply assembly 30 must be replenished. A sensor may be provided to detect an end of the sheet stock material and alert the packer or stop the converter 26.

In the orientation shown in FIG. 1, a packer might have difficulty accessing the stock supply assembly 30, which is elevated and behind the converter 26. And yet, in the operating position the converter 26 and the stock supply assembly 30 must be high enough to not interfere with boxes being transported underneath it on a conveyor or other packing surface. This may define a desired mounting height requirement. The height of the stock supply assembly 30 at this mounting height, however, may be too high for many operators to easily re-load.

Figure 2:
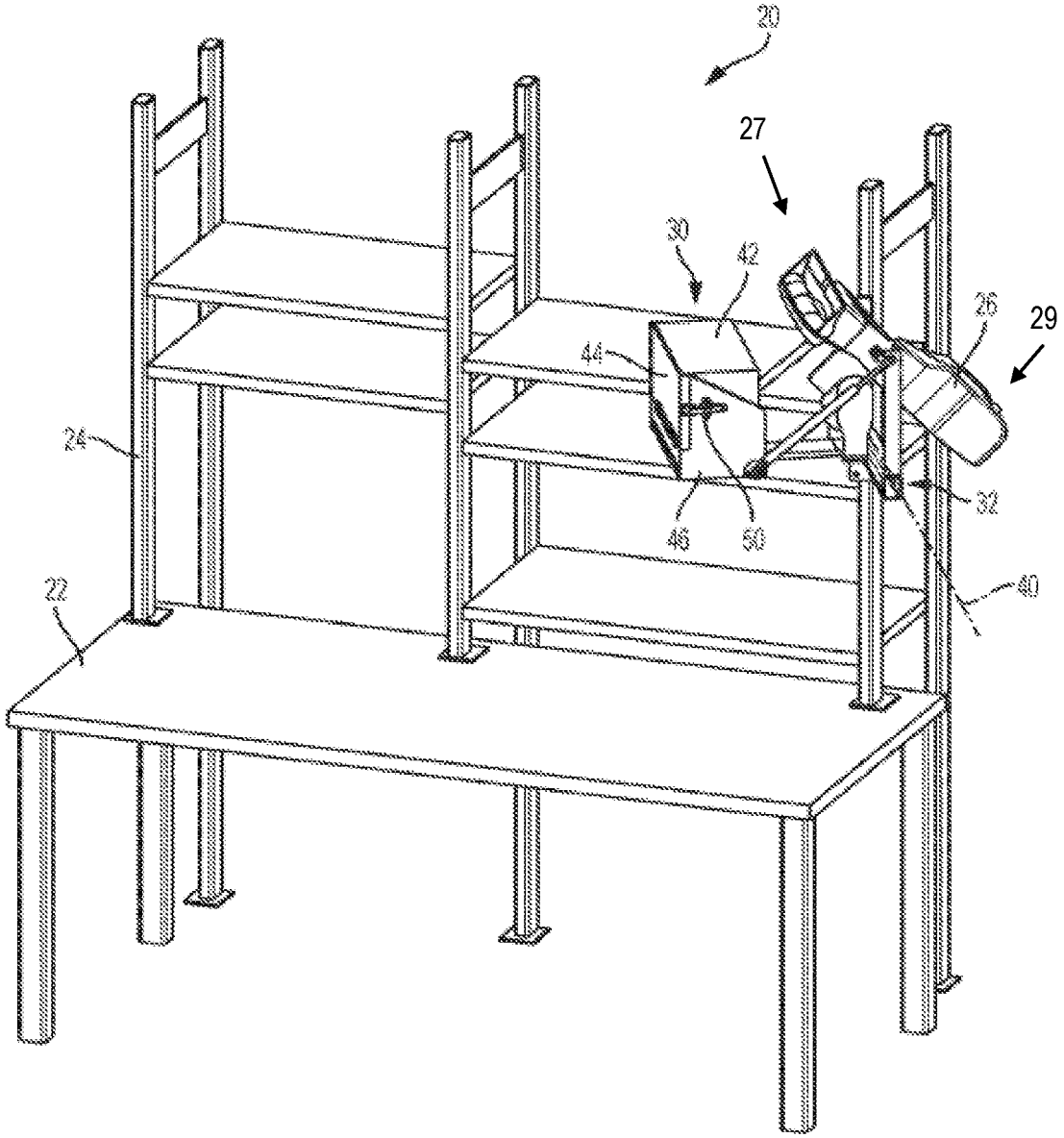
FIG. 2 is a perspective view of the packaging station of FIG. 1, where the dunnage conversion machine and stock supply assembly have been rotated about a vertical axis in preparation for loading a new supply of sheet stock material in the stock supply assembly.

To access the stock supply assembly 30, the converter 26 and the stock supply assembly 30 are rotated about the vertical axis 34 until the stock supply assembly 30 is above the packing surface 22, and the converter 26 is beside or behind the stock supply assembly 30, as shown in FIG. 2. In this orientation, the stock supply assembly 30 is still at an elevated operating position. To further facilitate access to the stock supply assembly 30, the operator can rotate the converter 26 and the stock supply assembly 30 about a substantially horizontal axis 40 to lower the stock supply assembly 30 to a relatively lower loading position, as shown in FIG. 3.

Figure 3:
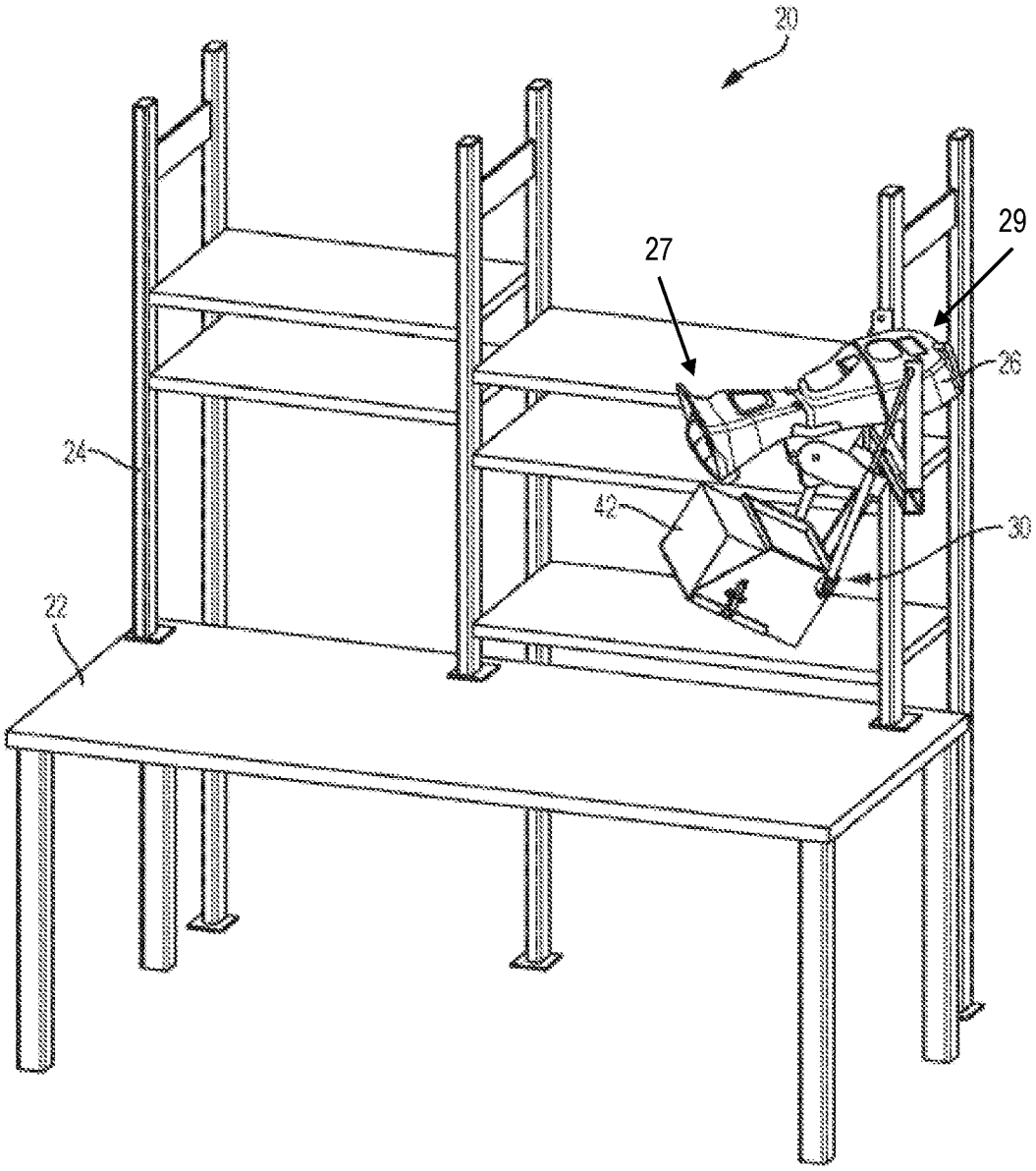
FIG. 3 is a is a perspective view of the packaging station of FIG. 2, where the stock supply assembly has been rotated from an elevated operating position (FIG. 2) to a relatively lower loading position.

In the course of rotating the stock supply assembly 30 from the elevated operating position of FIG. 2 to the relatively lower loading position of FIG. 3, and vice versa, the support structure 32 rotates from a substantially horizontal orientation in the operating position to an inclined orientation in the loading position. When the sheet stock material supported by the stock supply assembly 30 is a rectangular stack 42 of fan-folded sheet stock material, as is the case in the illustrated embodiment, the stock supply assembly 30 includes a generally rectangular shelf that supports the rectangular stack 42 of fan-folded sheet stock material. In the drawings the shelf is hidden by the stack 42 of fan-folded sheet stock material. Alternatively, the support structure 32 may include a pair of spaced-apart supports for receiving and supporting an axle that supports a roll of sheet stock material for rotation about the axle as the stock material is paid out to the converter 26.

While the shelf is substantially horizontal when the stock supply assembly 30 is in the operating position (FIG. 2), the shelf is inclined when rotated to the loading position (FIG. 3). Accordingly, the support structure 32 includes a support member 44 that helps to support the stack 42 of sheet stock material as the support structure 32 moves between the loading position and the operating position. To facilitate access to the shelf in the stock supply assembly 30 when loading a new supply of sheet stock material, such as a new stack of fan-folded sheet stock material, the support member 44 is movable relative to the shelf. In the illustrated embodiment, the support structure 32 includes upright walls 46 extending from respective edges of at least the two opposing ends of the rectangular shelf. The support member 44 closes the rear side of the stock supply assembly 30, away from the converter 26, and supports the stack 42 of fan-folded sheet stock material when the stock supply assembly 30 is in the loading position, and between the loading position and the operating position. The support member 44 is hingedly secured to the shelf, and respective catches 50 on the upright walls 46 secure the support member 44 in an upright orientation.

Figure 4:
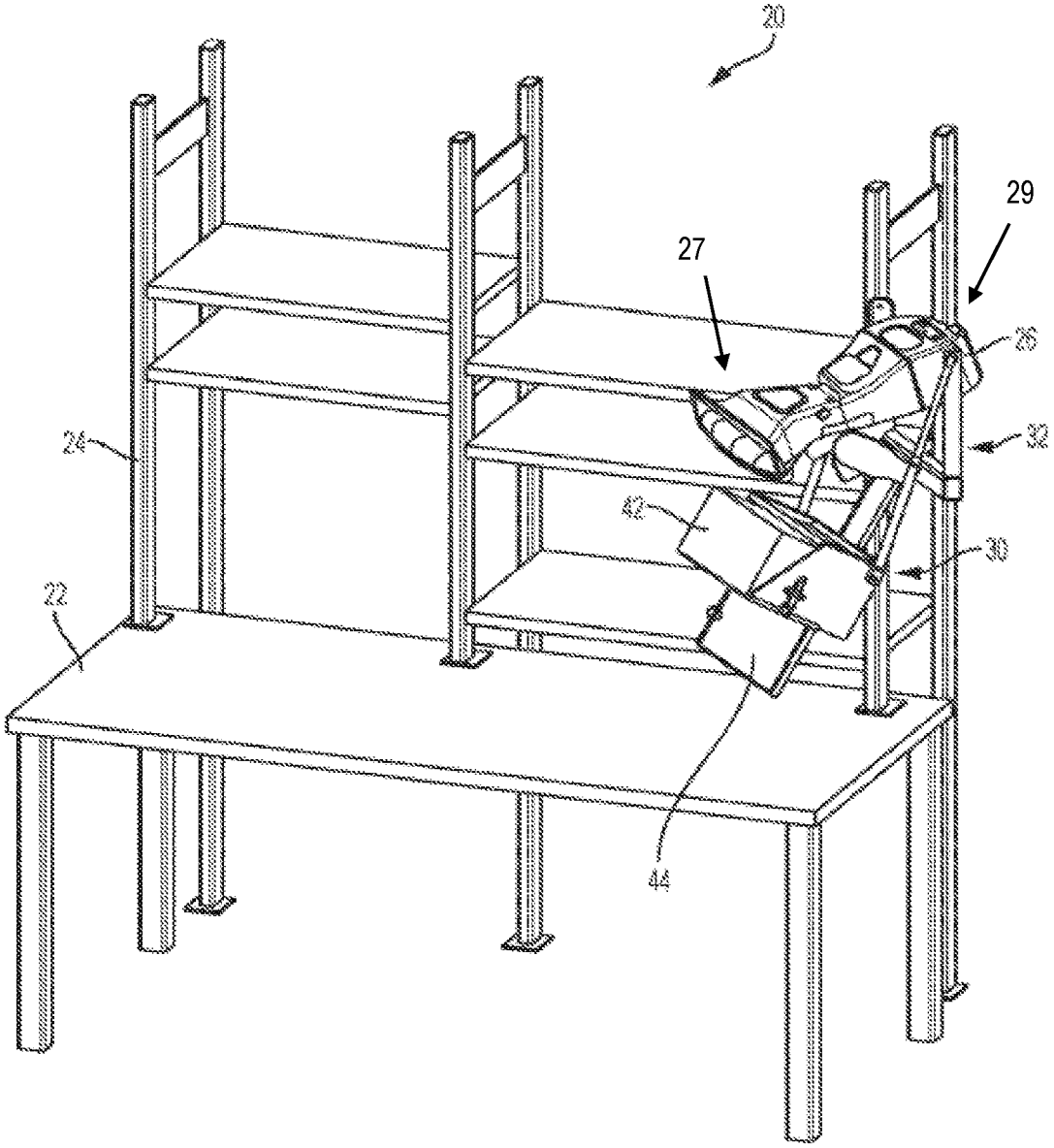
FIG. 4 is a is a perspective view of the packaging station of FIG. 3, where the stock supply assembly has been opened to facilitate loading a new supply of sheet stock material.

To access the shelf, the catches 50 are opened to release the support member 44, freeing the support member 44 to rotate downward, away from the upright walls 46, as shown in FIG. 4. Once a new stack 42 of sheet stock material is loaded in the stock supply assembly 30, the support member 44 is returned to its upright orientation and secured in place by the catches 50.

Figure 5:
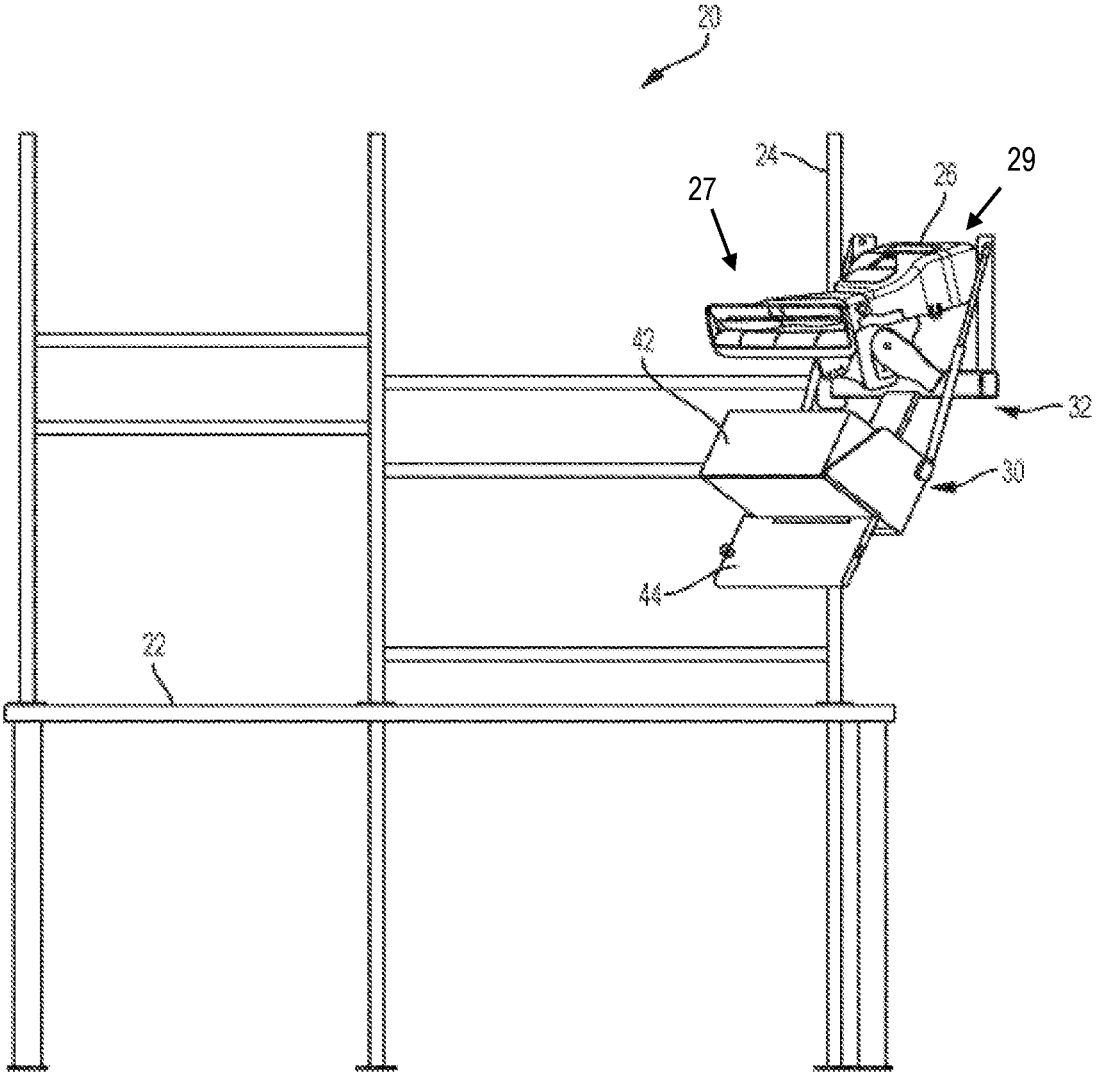
FIG. 5 is an elevation view of the packaging station of FIG. 4.
Figure 6:
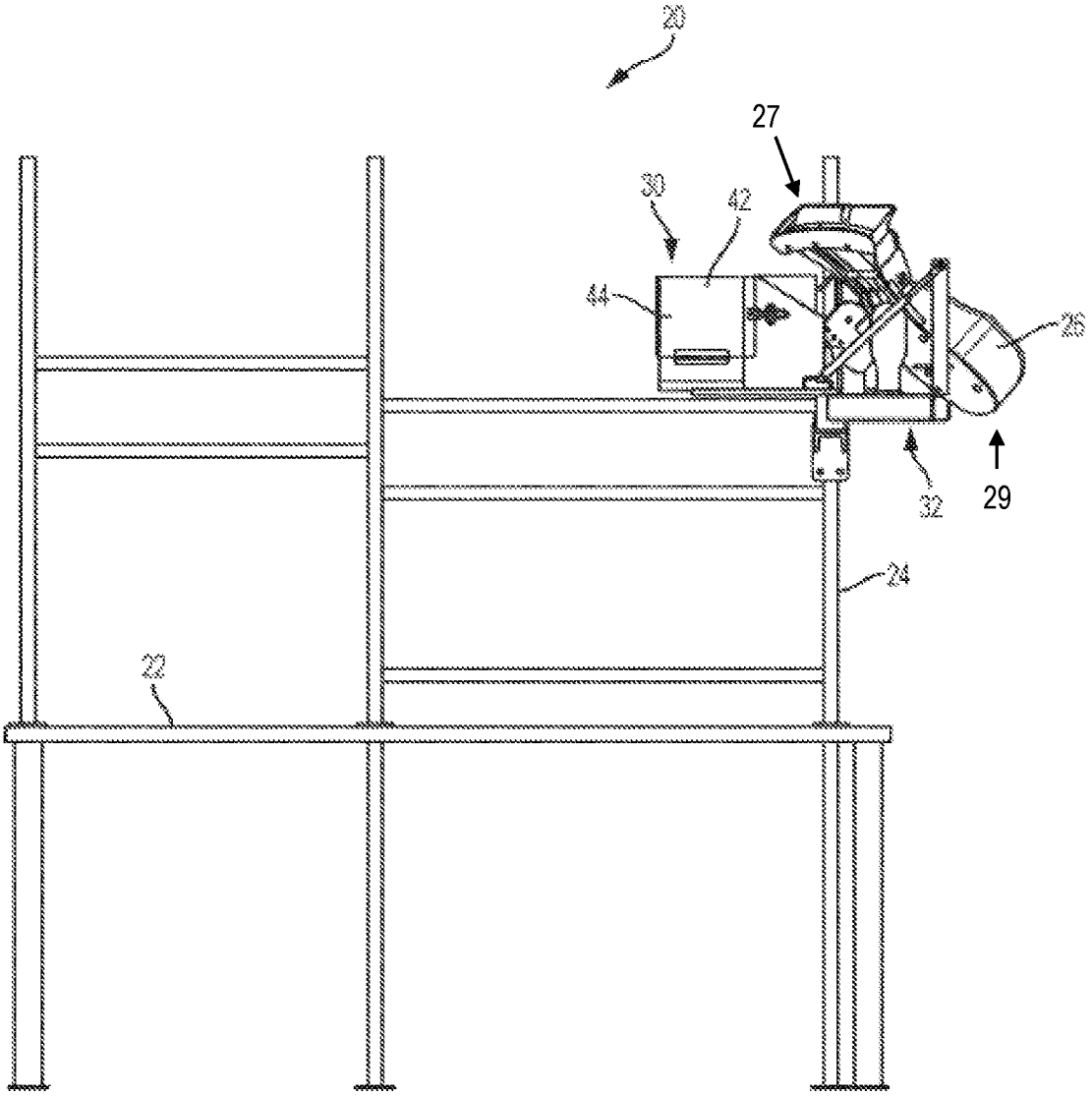
FIG. 6 is an elevation view of the packaging station of FIG. 2.

As seen in FIGS. 5 and 6, when the stock supply assembly 30 is in the loading position (FIG. 5) the stack 42 is substantially lower and more readily accessible than when the stock supply assembly has been returned to the operating position (FIG. 6).

Figure 7:
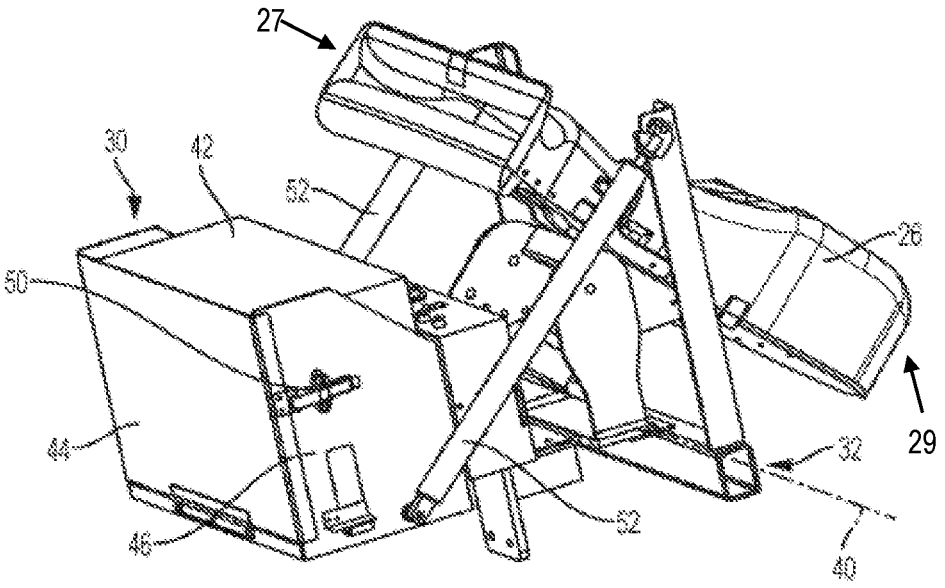
FIG. 7 is an enlarged rear perspective view of the dunnage conversion machine and stock supply assembly of FIG. 1.
Figure 8:
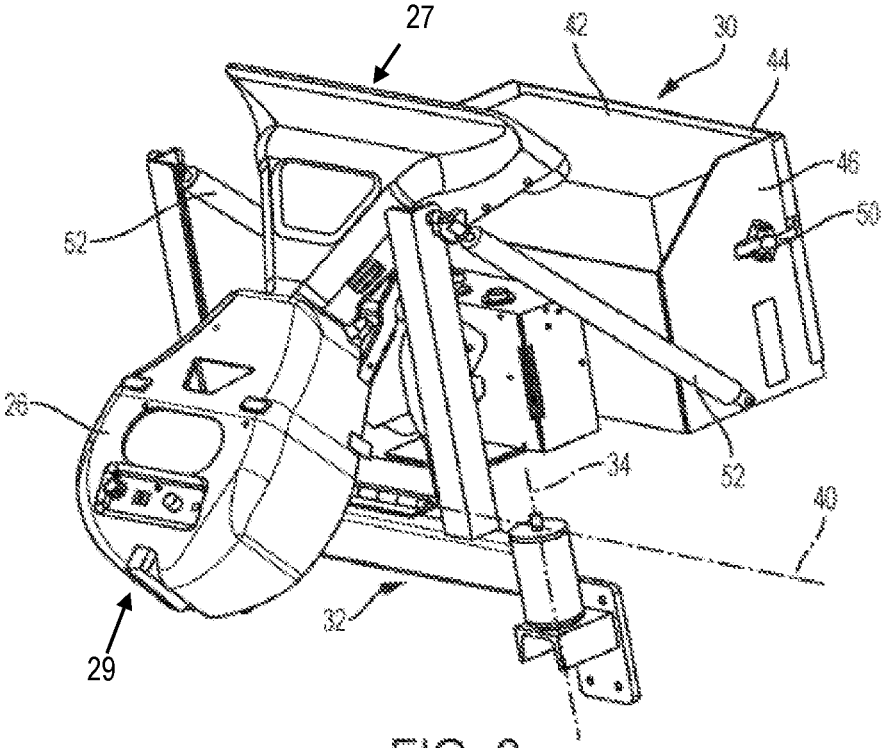
FIG. 8 is a front perspective view of the dunnage conversion machine and stock supply assembly of FIG. 7.

The converter 26, the stock supply assembly 30, and the support structure 32 also are shown in FIGS. 7 and 8. The support structure 32 is rotatable about the vertical axis 34 relative to the frame 24 (FIG. 1), and includes a horizontal axis 40, about which the converter 26 and the stock supply assembly 30 are rotatable. The support structure further includes one or more gas springs 52 that help to hold the stock supply assembly 30 in the operating and loading positions and to limit the rotation to the loading position. The gas springs 52 can be locked and unlocked through a Bowden cable control (not shown). The support member 44, upright walls 46, and catches 50 also are shown in FIGS. 7 and 8.

Figure 9:
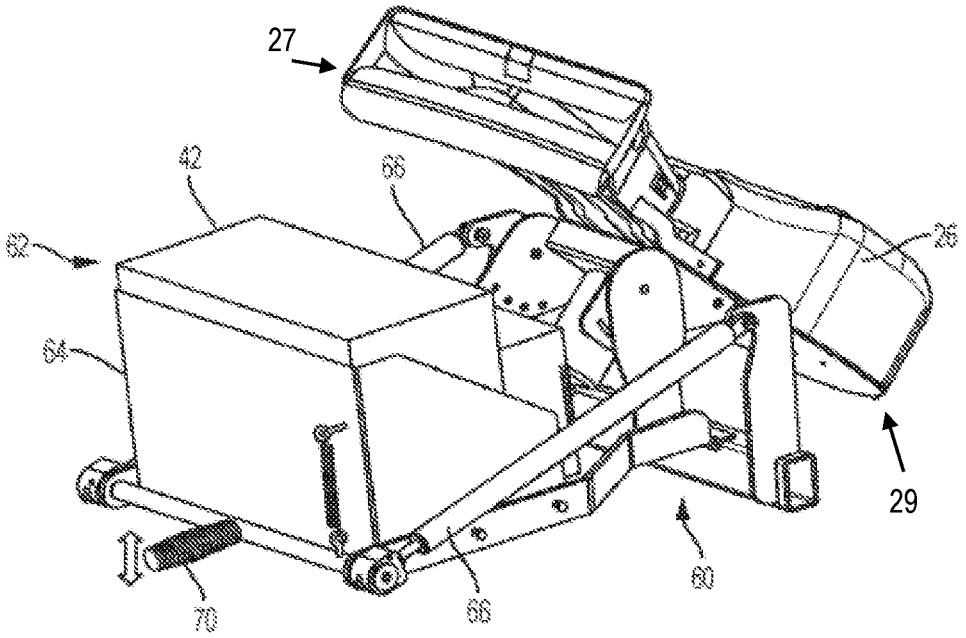
FIG. 9 is a rear perspective view of a dunnage conversion machine and an alternative stock supply assembly.
Figure 10:
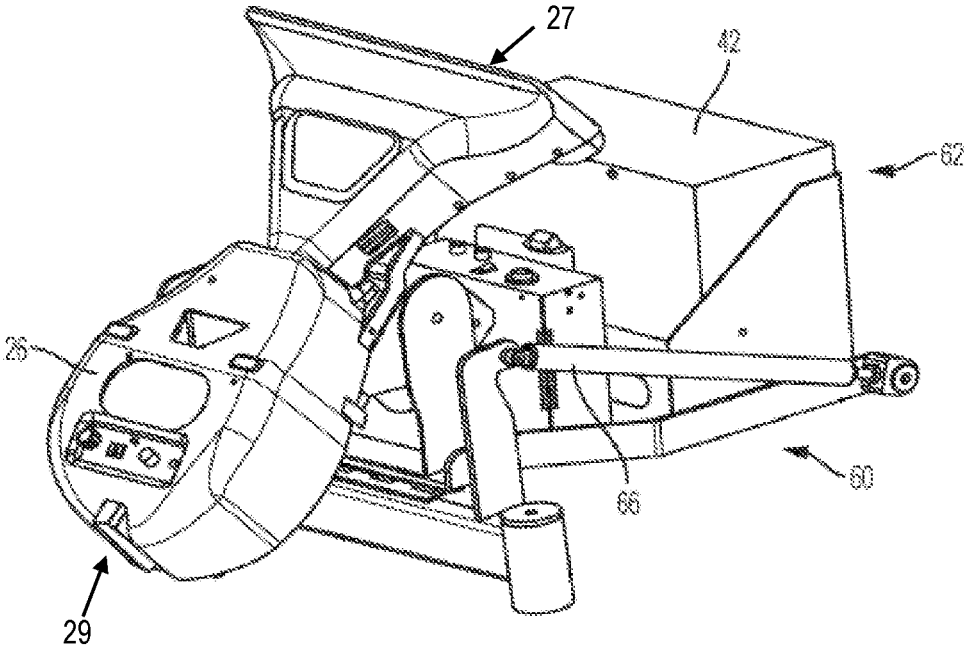
FIG. 10 is a front perspective view of the dunnage conversion machine and stock supply assembly of FIG. 9.

An alternative support structure 60 and stock supply assembly 62 is shown with a converter 22 in FIGS. 9 and 10. In this embodiment, the support structure 60 includes a different type of support member 64, and the gas springs 66 are mounted to facilitate increased rotation of the converter 26. The support member 64 may be rotatable Additionally, the support structure 60 includes a handle 70 that can be used to raise and lower the stock supply assembly 62 between the loading and operating positions, and also to control the gas springs 66. The position of the handle 70 can be used to lock and unlock the gas springs 66. For example, pushing the handle 70 up or down from a horizontal orientation may unlock the gas springs 66.

In summary, the present invention provides a stock supply assembly 30 for a dunnage conversion machine 26 that includes a stock material support having a support structure, such as a shelf for a stack of fan-folded sheet stock material. The stock supply assembly 30 is rotatable between a relatively lower loading position and a relatively higher operating position vertically displaced relative to the loading position.

Although the invention has been shown and described with respect to certain embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiments of the invention. In addition, while a particular feature of the invention may have been described above with respect to only one of several illustrated embodiments, such feature may be combined with one or more other features of the other embodiments, as may be desired and advantageous for any given or particular application.

The invention claimed is:

1. A stock supply assembly for a dunnage conversion machine, comprising:

a stock material support having a support structure that is movable between a relatively lower loading position and a relatively higher operating position vertically displaced relative to the loading position;

wherein the stock material support includes a linkage mechanism for moving the support structure between the loading position and the operating position;

wherein the linkage mechanism includes one or more gas springs that engage and hold the support structure in the operating position; and wherein the linkage mechanism includes a handle that facilitates moving the support structure between the loading position and the operating position and is configured to control locking and unlocking of the one or more gas springs.

2. A stock supply assembly as set forth in claim 1, where the support structure includes a shelf for supporting a stack of fan-folded sheet stock material.

3. A stock supply assembly as set forth in claim 1, where the support structure includes a horizontal shelf for supporting a stack of fan-folded sheet stock material.

4. A stock supply assembly as set forth in claim 1, where the one or more gas springs include a pair of gas springs connected to the support structure at laterally spaced locations that operate in tandem.

5. A stock supply assembly as set forth in claim 1, where the stock material support is mounted to a frame and is rotatable about a vertical axis.

6. A dunnage conversion machine comprising:

a stock supply assembly including:

a stock material support having a support structure that is movable between a relatively lower loading position and a relatively higher operating position vertically displaced relative to the loading position;

where the stock material support includes a linkage mechanism for moving the support structure between the loading position and the operating position; and where the linkage mechanism includes:

one or more gas springs that engage and hold the support structure in the operating position; and a handle that facilitates moving the support structure between the loading position and the operating position and is configured to control locking and unlocking of the one or more gas springs; and a conversion assembly downstream of the stock supply assembly that converts a sheet stock material into a relatively thicker and less dense dunnage product.

7. The dunnage conversion machine as set forth in claim 6, where the linkage mechanism connects the support structure to the dunnage conversion machine, the linkage mechanism being configured to rotate an upstream end of the dunnage conversion machine downward when the support structure is moved to the loading position to facilitate loading a leading end of a new supply of sheet stock material into the conversion machine.

8. A method of loading a sheet stock material for conversion into a relatively lower density dunnage product, comprising the following steps:

engaging a handle to unlock one or more gas springs that are holding a stock material support structure in an elevated operating position;

lowering the stock material support structure from the elevated operating position to a relatively lower loading position;

loading a supply of sheet stock material onto the support structure at the loading position;

raising the support structure from the loading position to the elevated operating position and engaging the handle to lock the one or more gas springs to hold the support structure in the elevated operating position; and feeding sheet stock material from the supply into a dunnage conversion machine and operating the dunnage conversion machine to produce one or more dunnage products from the supply of sheet stock material.

9. A method as set forth in claim 8, further comprising the step of rotating a stock supply assembly that includes the stock material support structure about a vertical axis.

10. A method as set forth in claim 9, where the rotating step includes rotating the dunnage conversion machine.

11. A method as set forth in claim 8, where the lowering step includes rotating the dunnage conversion machine about a horizontal axis to lower an upstream end of the conversion machine.

12. A method as set forth in claim 8, where the raising step includes rotating the dunnage conversion machine about a horizontal axis to lower a downstream end of the conversion machine.

* * * * *